United States Patent [19]

Rosenkrantz et al.

[11] 4,434,938

[45] Mar. 6, 1984

[54] AROMA SYSTEM

[76] Inventors: Evelyn S. Rosenkrantz; Edward Rosenkrantz, both of 4915 Tyrone Ave., Sherman Oaks, Calif. 91403

[21] Appl. No.: 365,214

[22] Filed: Apr. 5, 1982

[51] Int. Cl.[3] ..... B05B 15/00

[52] U.S. Cl. ..... 239/274; 239/289; 239/333

[58] Field of Search ..... 239/274, 289, 283, 329, 239/331, 333, 334; 222/385

[56] References Cited

U.S. PATENT DOCUMENTS

| | | | |
|---|---|---|---|
| 3,182,337 | 5/1965 | Price | 222/180 X |
| 3,500,771 | 3/1970 | Fischer et al. | 239/274 X |
| 4,056,228 | 11/1977 | Rosenkrantz et al. | 239/274 |

FOREIGN PATENT DOCUMENTS

| | | | |
|---|---|---|---|
| 551104 | 3/1923 | France | 222/385 |
| 688500 | 3/1953 | United Kingdom | 222/385 |

*Primary Examiner*—John J. Love
*Assistant Examiner*—Mary McCarthy
*Attorney, Agent, or Firm*—Paul J. Sutton

[57] ABSTRACT

The present invention presents an aroma system for use with toilets and the like. In the present aroma system an improved pump has been combined with a container to provide a compact and trouble-free system. The pump is activated by the toilet handle when the toilet is flushed. Pump activation releases a preselected aroma which will mask the normal toilet odor. Provision is made for the removal of the pump and container combination from the toilet for servicing and refilling. Removal is accomplished by unfastening a special fastening device which is designed to be tamper proof.

1 Claim, 5 Drawing Figures

FIG. 1
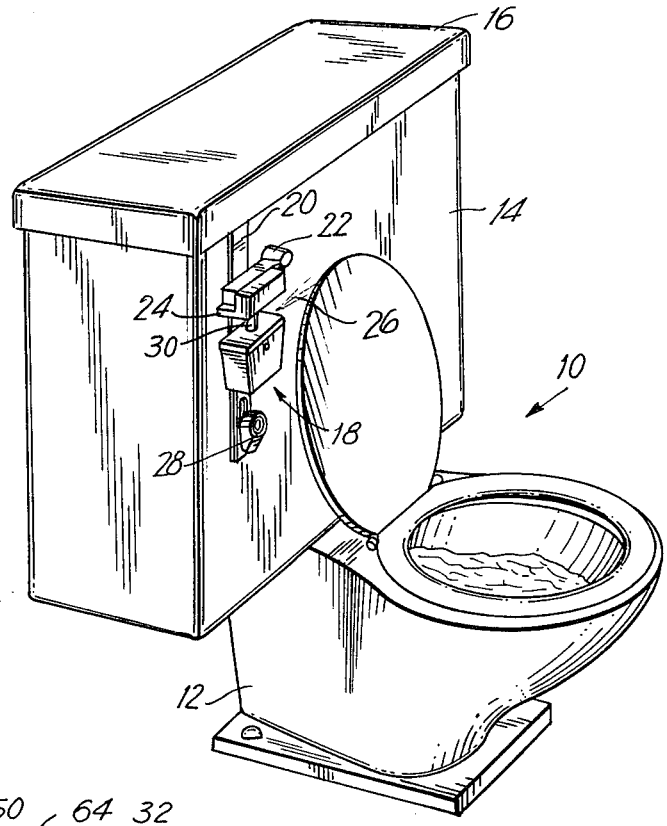
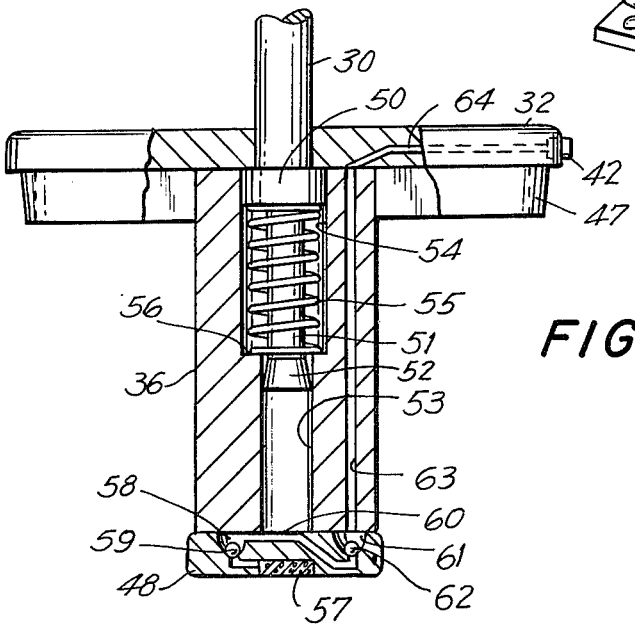
FIG. 4
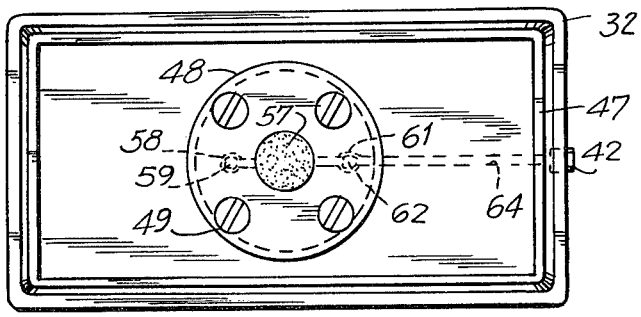
FIG. 5

AROMA SYSTEM

BACKGROUND OF THE INVENTION

1. Field of the Invention

This invention relates to aroma dispensing devices in general. Particularly this invention is related to the combination of an aroma dispensing device and a toilet.

2. Description of the Prior Art

The following patents are prior art attempts to solve the problem which the present invention has solved.

U.S. Pat. No. 4,056,228 to E. S. Rosenkrantz et al. discloses an aroma system which is based upon the use of a spray nozzle assembly pump 44 which distributes the deodorant liquid 50. In an attempt to reduce part costs the pump assembly 44 is a commercially available spray nozzle which may also be used with cans and bottles. The use of pump assembly 44 required that a spray refiner 22 be used to direct the spray into the room. Of necessity spray refiner 22 consists of openings in the side wall 51 of flush box 20. The opening presented by spray refiner 22 also allows the deodorant liquid 50 to leak out of flush box 20 if the flush box 20 is improperly handled during or after removal from the toilet tank 12. Further, there is no disclosure for preventing unauthorized persons from removing or disabling the aroma system.

U.S. Pat. No. 2,586,266 to Santarelli discloses a sprayer which comprises a pump mechanism which may be used with a container 19 or removed from container 19 and used with a similar container. Santarelli's disclosure is directed to a device useful for spraying trees and plants as well as fire fighting purposes. It is conceivable that his pump may be used in an aroma system but there is no suggestion of this in his disclosure.

U.S. Pat. No. 2,795,799 to Dickerman discloses a device for activating aerosol containers. The aerosol released would then be useful for deodorizing purposes. Shown in his drawings are a supporting structure 26 attached to a toilet bowl rim 10. A seat 16 is arranged to operate an outer tubular member 28. As the outer tubular member 28 is operated it causes the valve 40 of aerosol spray container 42 to release deodorant spray. The deodorant spray is released as the toilet seat 16 is lifted. The attachment of Dickerman's device to the rim 10 of the toilet bowl presents a problem when cleaning the interior portion of the toilet bowl. Dickerman's hanger 22 will provide places for dirt to accumulate as the interior of the toilet bowl is cleaned. Further, the proximity of the spray valve 40 to the seat 16 may cause a person using the invention to receive the deodorant spray on his or her clothing causing the clothing to soil.

U.S. Pat. No. 3,182,337 to N. W. Price as well as U. S. Pat. No. 3,068,492 to N. W. Price both describe different bracket designs for holding deodorant aerosol cans onto a toilet tank wall 1. A mechanism is shown for holding the aerosol cans onto a toilet tank wall 1. The mechanism shown for holding the aerosol cans 3 and 12 require considerable skill to adjust for proper operation and to readjust after replacement of an aerosol can. Further, the arm mechanism 9 and 14 which makes contact with the operating lever 2 and 3 of the tank is not enclosed and therefore may be damaged by catching in the clothing of persons operating the above described systems.

German Pat. No. 954013 to Ratingen describes an enclosure for use in a room having toilets and the like.

The enclosure disclosure by Ratingen houses a pump 5 and a reservoir 6. Manual operation of ball 10 will cause expulsion of the deodorant. The deodorant release in the Ratingen disclosure is not automatically performed by flushing a toilet but must be manually performed as required by a person within the room having toilets.

British Pat. No. 1,021,586 to Owensmith et al. discloses an apparatus for holding an aerosol dispenser can 4 and having a solenoid 2 disposed in line with valve 22 so that operation of solenoid 2 will cause dispenser can 4 to release the aerosol contained within. The apparatus may generally be disposed about a room and requires a source of current to operate the solenoid 2. Owensmith's disclosure suggests the use of a clock operated timer to periodically release the aerosol. The disclosure by Owensmith et al. does not consider the release of the aerosol at the time needed, namely after use of a toilet or the like. Rather, Owensmith et al. consider the release of the aerosol on a period basis with a consequent waste of aerosol deodorant since the deodorant is not needed at all times.

In summary, the prior art represented by Rosenkrantz et al. presents a relatively complicated aroma system based upon a commercially available pump assembly. The present invention is a simpler aroma system with a fewer moving parts together with a unique pump and enclosed container. The present invention further discloses a means for preventing unauthorized tampering which is not considered in any of the prior art.

Santarelli directs his disclosure to spraying trees and shrubs as well as fires and does not attempt to solve the problem of deodorizing a toilet.

Dickerman discloses the release of a deodorant at toilet seat level and attaches his device to the toilet bowl which provides difficulties when trying to clean the bowl. Further, his dispenser could conceivably wet a person or wet and soil a persons clothing which is not possible with the present invention.

The two N. W. Price patents are similar in that they both require great skill to adjust before and after changing aerosol cans. Further, the mechanisms described by Price are not protected and can easily catch in clothing. The present invention does not require such skillful adjustment and is completely enclosed.

The patent to Ratingen describes an aerosol dispensing device which is manually operated at some time after or before use of a toilet. The present invention is operable at the same instant that the toilet is flushed and therefore requires only one action on the part of the person doing the flushing.

The patent to Owensmith et al. describes an apparatus for periodically dispensing an aerosol under direction of timing mechanism. The apparatus of Owensmith et al. washes the aerosol and requires an electrical timing source. Use of the electrical operation would prove hazardous when applied to a toilet. The present invention provides for a safe, simple and reliable device for dispensing aerosols and is economical to operate because of the release of the aerosol only when flushing.

BRIEF SUMMARY OF THE INVENTION

The improved aroma system of the present invention is a compact pump and container combination which is designed to be locked to the tank of a toilet by means of bracket. The bracket is itself locked to the toilet tank thereby preventing unauthorized removal of the aroma system. The pump portion of the aroma system is placed in a position which enables it to be activated by the same handle which is used to flush the toilet. The exit nozzle of the aroma system is placed so that it releases the deodorant in an area where it will be effective.

An object of the present invention is to present an improved aroma system.

Another object is to provide a compact combined pump and container.

Still another object is to provide a non-clogging efficient pump.

Still yet another object is to provide a tamper-proof aroma system.

For a better understanding of the invention, together with other details and features thereof, reference is made to the following description taken in connection with the accompanying drawings.

BRIEF DESCRIPTION OF THE DRAWINGS

FIG. 1 improved aroma system attached to toilet tank;

FIG. 4 partial cross-section of aroma system cover;

FIG. 5 partial bottom view of aroma system cover.

DESCRIPTION OF THE PREFERRED EMBODIMENT

Figure 3:
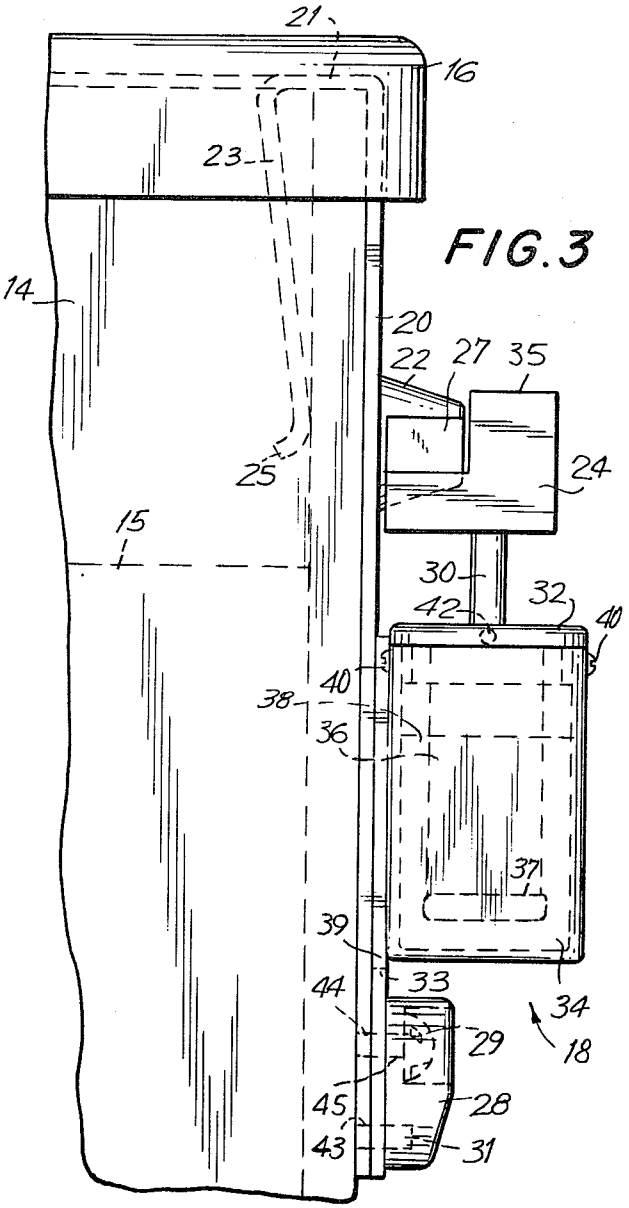
FIG. 3 fragmentary side view of improved aroma system and toilet tank.

FIG. 1 illustrates an improved aroma system attached to a toilet tank, generally designated 10. Shown here is a toilet bowl 12 having a tank attached in the normal manner. Sitting on the top of tank 14 is a tank cover 16 which has been attached to the tank 14 in a manner (now shown) so as to prevent unauthorized removal. A hanger bracket 20 is shown placed over the front wall of the tank 14. The aroma system generally designated, 18 is attached to the hanger bracket 20 by a lock mechanism 28. It can be seen that a pump handle 24 is abuting a tank handle 22 so that the pump handle 24 and the tank handle 22 are operated together. A spray of deodorant 26 is shown issuing from the side of the improved aroma system 18 so as to indicate the area to be deodorized.

Figure 2:
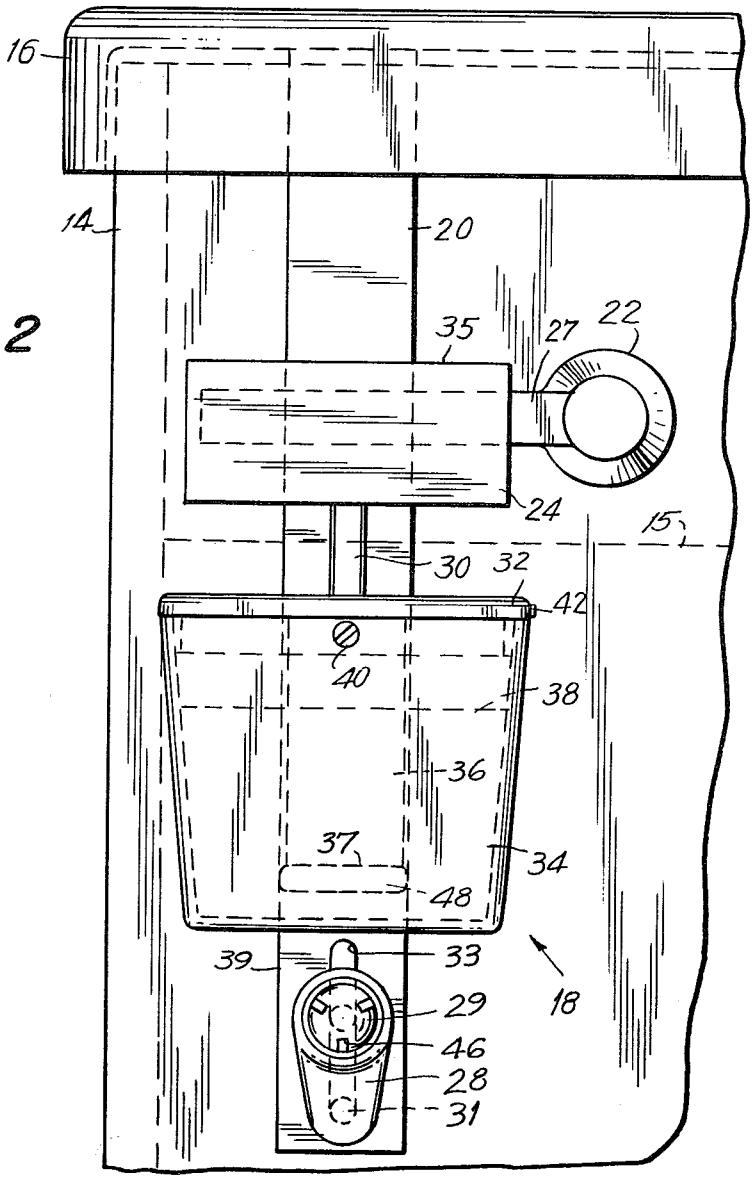
FIG. 2 fragmentary front view of improved aroma system and toilet tank.

FIGS. 2 and 3 show a detailed view of the improved aroma system 18 attached to the toilet tank 12. Aroma system 18 is detachably affixed to the hanger bracket 20 which is shown hooked over the front face of the toilet tank 14. Hanger bracket 20 fits between the inside of toilet tank cover 16 and the lip of toilet tank 14. The tank 14 is shown with tank water 15 which is the level of water for flushing the toilet. Additionally the tank handle 22 is shown with a straight portion 27 in abutment with the pump handle 24. A top portion 35 of pump handle 24 is approximately at the same level as the top of the straight portion 27 of the tank handle 22. A pump plunger 30 is seen protruding from a system cover 32. Attached to the system cover 32 is a pump body 36 having a bottom 37 immersed below a deodorant level. The deodorant 38 is contained within a system tank 34 to which the system cover 32 is attached by a pair of fasteners 40. A support bracket 39 (best seen in FIG. 3) is attached (by means not shown) to the system tank 34. The support bracket 39 is adjustably attached to the hanger bracket 20. A slot 33 in the support bracket 39 permits adjustment of the abutment between the pump handle 24 and the tank handle 22. A locking mechanism 28 is comprised of a somewhat oblong body having a lock screw 29 at its upper end and a lock pin 31 at its lower end. The pin 31 is attached to locking mechanism 28 and fits into a clearance hole 43 (best seen in FIG. 3) found in the hanger bracket 20. The lock screw 29 has a threaded portion 45 which engages a threaded hole 44 in the hanger bracket 20. The lock screw 29 includes a set of three partial slots 46 which are engaged by a special tool (not shown) to prevent unauthorized adjustments.

FIG. 3 shows a few additional details not shown in FIG. 2 and these will be named. The hanger bracket 20 can be seen to have a bend 21 which permits it to rest on the lip of toilet tank 14. A reverse portion 23 is angled toward the wall of the toilet tank 14 and clamps the hanger bracket 20 to the wall of the tank 14. A lip portion 25 allows the hanger bracket 20 to be removed if required without damaging the toilet tank 14. Also shown in both FIG. 2 and FIG. 3 is a spray nozzle 42 which directs the deodorant spray 26 as shown in FIG. 1.

FIG. 4 shows a partial cross-section of the system cover 32. Here can be seen a flange 47 which fits inside the system tank 34. The pump body 36 is shown abutting the inside of the system cover 32 at one end and having an end cap 48 at the other end. The end cap 48, the pump body 36, and the system cover 32, are held together by a set of screws, 49, best seen in FIG. 5. The pump plunger 30 fits slidingly through a hold in the system cover 32. The pump plunger is prevented from passing completely through the hole in cover 32 by a stop ridge 50. The stop ridge 50 then abuts a reduced diameter portion 51 which has a teflow seal 52 affixed. Teflow seal 52 is tapered as shown so that its lower portion is compressed when it fits into a bore 53 in the lower portion of the pump body 36. The upper portion of teflow seal 52 is tapered to a diameter less than that of its lower portion of the seal 52 and the reduced diameter portion 51 will clear the bore 53. The upper portion of pump body 36 has an enlarged bore 54 which houses a spring 55. Spring 55 bears against a ridge wall 56 and the stop ridge 50, pushing them apart when spring 55 is compressed.

The end cap 48 is shown in section in FIG. 4 in order to show the pump valving. An intake port 57 is shown. The port 57 is filled with a porous plug which serves to filter the deodorant liquid in which it is immersed. Intake port 57 opens to a first valve chamber 58 having a first ball 59. The ball 59 rests on the bottom of first valve chamber 58 and prevents the passage of deodorant fluid in that position. The upper portion of first valve chamber 58 opens to a central opening 60 which provides access to the pump formed by teflow seal 52 and bore 53. The central opening 60 is also connected by a passageway to a second valve chamber 61. Within the second valve chamber 61 is a second ball 62 resting on the bottom of second valve chamber 61. When the second ball 62 is resting on the bottom of second valve chamber 61 the passage of deodorant fluid is prevented. Second chamber 61 has its top portion open to a small bore 63 drilled in pump body 36 connecting to a series of passageway 64 formed into system cover 32. The series of passageways 64 opens to the spray nozzle 42 formed of a plastic material.

Operation of the improved aroma system 18 is as follows. The hanger bracket 20 is slipped onto a toilet tank wall as shown in FIG. 1. The system tank 34 is partially filled with deodorant liquid and assembled to the system cover 32. The improved aroma system 18 is attached to the hanger bracket 20 by the lock screw 29 by using an appropriate tool. The system 18 may be slidably moved up and down until the straight portion 27 of the tank handle 22 is abuting the pump handle 24. In assembling the system cover 32 and the system tank 34 care must be taken to point the spray nozzle 42 toward the toilet bowl 12 and that the fasteners 40 have been placed. With the aforementioned preparatory work done, a simple flushing of the toilet 10 will cause the pump handle 24 to be depressed resulting in the spray of deodorant 26.

Operation of the spray pump mechanism is as follows. Intake port 57 is immersed in the deodorant liquid 38 as seen in FIGS. 2 and 3 and initially there is no liquid 38 in the pump formed by the teflow seal 52 and the bore 53. When the toilet 10 is first flushed, pump handle 24 is pushed toward the system cover 32. The movement of pump handle 24 is pushed toward the system cover 32. The movement of pump handle 24 causes the pump plunger 30 to moves downward causing the spring 55 to compress. As the pump plunger 30 moves downward it causes the flow seal 52 to move into the bore 53 and whatever air is in the pump chamber pushes against both the first ball 59 and the second ball 62. The compressed air pushes on the first ball 59 causing it to rest more heavily on the bottom of first valve chamber 58 and causing the passage to remain sealed. The compressed air pressing against the second ball 62 does so from the bottom of the second valve chamber 61 and eventually overcomes the weight of the second ball, unsealing the second valve chamber 61 and allowing air to escape through the connecting passages to spray orifices 42. When the tank handle 22 is released the compressed spring 55 forces both the tank handle 22 and the pump handle 24 back to their original position. As the teflow seal 52 returns to its original position it lowers the pressure in the pump and atmospheric pressure on the surface of the deodorant liquid 38 forces it into the intake port 57 and causes it to lift the first ball 59. The deodorant liquid 38 now fills the pump and is ready to be released on the next flushing.

The next flushing takes place when the tank handle 22 is again activated after use of the toilet 10. Activation of the tank handle 22 causes the pump handle 24, attached to one end of the pump plunger 30, to move the pump plunger 30 causing the teflow seal 52, which is attached to the other end of the pump plunger 30, to move along the bore 53 toward the end cap 48. The deodorant 38 which filled the pump formed by teflow seal 52 and the bore 53 is now forced out of the pump area as the pump volume is reduced by the movement of the teflow seal 52. The deodorant fluid 38 is forced into both passages which lead from the central opening 60 to the first valve chamber 58 and to the second valve chamber 61. The first ball 59 and the second ball 62 are sealing their respective valve chambers because of the weight of the ball 59 and 62. The valve chambers 58 and 61 are designed to be sealded when only the force of gravity acts upon the first ball 59 and the second ball 62. Consequently as the deodorant fluid 38 is forced out of the pump passage, its force is communicated to the first ball 59 and the second ball 62. The force of the deodorant 38 on the first ball 59 is in a direction such that the deodorant force aids the force of gravity acting on the first ball 59 to help maintain the first valve chamber 58 in the sealed condition. On the other hand, the force of the deodorant fluid 38 on the second ball 62 is in a direction such that the deodorant force acts in a direction counter to the force of gravity acting on second ball 62. The weight of second ball 62 serves to keep the second valve chamber 61 in the sealed condition until the force of the deodorant fluid 38 overcomes the weight of the second ball 62. When this happens the deodorant 38 enters the small bore 63 in the pump body 36 and thereby also enters the series of passageway 64 in the system cover 32. The deodorant fluid 38 is then expelled through the spray nozzle 42, shown in FIG. 1, as the spray of deodorant 26.

While the present invention has been disclosed in connection with the preferred embodiment thereof, it should be understood that there may be other embodiments which fall within the spirit and scope of the invention as defined by the following claims.

What is claimed is:

1. An improved aroma emitting device for cooperative use with a toilet handle, comprising in combination:

a housing consisting of, a refillable fluid reservoir having a cover detachably fastened to said reservoir, said cover having a pump means depending from said cover and communicating with said fluid reservoir for generating a mist proximate said cover;

activating means extending from said cover and having a handle attached thereto for engagement with said toilet handle so as to generate said mist when said toilet handle is activated;

said housing having a support bracket attached to said refillable reservoir portion thereof for adjustable engagement with a hanger bracket attached to a toilet tank wall and proximate said toilet handle, said support bracket being slidably detachably affixed to said hanger bracket by a lock mechanism, said pump means comprised of a valve member affixed to a pump body, said valve member being remote from said cover and extending below the level of said fluid reservoir, said pump body having a longitudinal bore there through and said bore having a first diameter portion and a second diameter portion, said first diameter portion abuting said valve chamber and said second diameter portion abuting said cover, said longitudinal bore further having a shoulder at the mid portion of said pump body, contained within said longitudinal bore is said activating means comprised of a plunger having a collar at its mid portion, a third diameter portion extend from said cover, and a fourth diameter housed within said longitudinal bore, and having a pump seal attached to said fourth diameter, said pump seal being larger in diameter than said first diameter portion and slidingly engaged with said first diameter;

a spring coaxial with said fourth diameter and housed within said second diameter, abutting said shoulder and said collar so that when said activating means is operated said spring is compressed, a said valve chamber having a first ball valve, and a second, non biased ball valve, an intake port in communication with said fluid reservoir, and a common port in communication with said first diameter portion of said longitudinal bore said intake port having a filter element therein for the removal of particulate matter from said fluid entering said pump means;

a first passageway serves to connect said intake port with said first ball valve, and a second passageway serves to connect said first ball valve with said common port;

a third passageway serves to connect said second ball valve with said common port;

a fourth passageway in said pump body serves to connect said second ball valve with a fifth passageway in said cover which commmunicates with a spray nozzle affixed to said cover whereby activation of said toilet handle causes said fluid to be expelled from said spray nozzle.

* * * * *